United States Patent [19]

Masahiko et al.

[11] 4,154,269

[45] May 15, 1979

[54] METHOD FOR FORMING WIRE STOCKS INTO COILS

[75] Inventors: Yamada Masahiko, Yokosuka; Kagawa Kazuo, Yokohama, both of Japan

[73] Assignee: Showa Electric Wire & Cable Co., Ltd., Kawsaki, Japan

[21] Appl. No.: 829,371

[22] Filed: Aug. 31, 1977

[30] Foreign Application Priority Data

Aug. 31, 1976 [JP] Japan ..... 51/104166

[51] Int. Cl.[2] ..... B21F 21/00

[52] U.S. Cl. ..... 140/2; 100/3; 242/81

[58] Field of Search ..... 242/79, 80, 81, 82, 242/83; 140/1, 2, 102; 100/3

[56] References Cited

U.S. PATENT DOCUMENTS

| | | | |
|---|---|---|---|
| 553,353 | 1/1896 | Morgan | 242/81 |
| 3,496,966 | 2/1970 | Reth et al. | 140/1 |
| 3,618,871 | 11/1971 | Gilvar | 242/81 |

*Primary Examiner*—Lowell A. Larson
*Attorney, Agent, or Firm*—Fred Philpitt

[57] ABSTRACT

A wire stock is continuously deformed into a coil and the coil is temporarily stored in a storing device as a bundle. The bottom of the storing device is periodically closed and opened for discharging the bundle into a receptor and for piling up the bundles one upon the other. By the impact force of a falling bundle, already accumulated bundles are compacted.

2 Claims, 3 Drawing Figures

METHOD FOR FORMING WIRE STOCKS INTO COILS

BACKGROUND OF THE INVENTION

This invention relates to a method and apparatus for forming a wire stock into a coil.

When manufacturing a hard drawn copper wire by dip forming process, for example, a wire stock coated with copper in a crucible is hot rolled to a desired diameter, and the rolled wire stock is formed into a coil by means of a coiler. The formed coil is then dropped onto a carrier or pallet. With such an arrangement, since the coil is dropped by its own weight to be accumulated on the carrier or pallet, gaps are formed between coil turns thus impairing the space factor of the coil. Moreover, coil turns of one coil enter into the gaps of the other coil thus causing tangling of the wire stock when it is paid out in the succeeding stage.

To obviate this difficulty, it has been proposed to vibrate the carrier or the pallet during the coiling operation so as to prevent formation of gaps between successively falling turns. This arrangement can efficiently eliminate the gaps between the turns when the diameter of the wire stock is small, but when the wire diameter is large it is necessary to apply a considerably large vibration to eliminate the gaps between the coil turns. This required a powerful vibration device. Even with such a powerful vibration device, the result is not always satisfactory.

SUMMARY OF THE INVENTION

Accordingly, it is an object of this invention to provide a novel method and apparatus for forming a wire stock into a coil capable of forming coils with a minimum of gaps and which can prevent tangling of the wire stock even when it has a large diameter.

Another object of this invention is to provide an improved method and apparatus for forming a wire stock into a coil by using a conventional coiling machine with a slight modification or attachment.

According to one aspect of this invention there is provided a method of forming a wire stock into a coil comprising the steps of continuously deforming a wire stock into a coil, temporarily arresting the coil thus forming a bundle of coils and successively dropping the bundle into a receptor one above the other.

According to another aspect of this invention there is provided apparatus for forming a wire stock into a coil comprising means for continuously deforming the wire stock into a coil, storing means for temporarily storing the coil as a bundle of coils, and means for periodically discharging the bundles into a receptor.

BRIEF DESCRIPTION OF THE DRAWINGS

The invention can be more fully understood from the following detailed description taken in conjunction with the accompanying drawing in which.

DESCRIPTION OF THE PREFERRED EMBODIMENT

Figure 1:
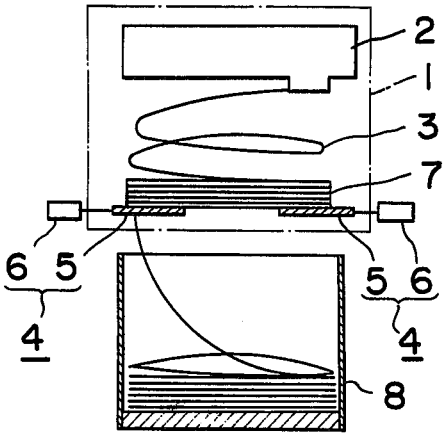
FIG. 1 is a diagrammatic sectional view showing one example of a coiler embodying this invention.

As shown in FIG. 1, a continuous coiler 1 comprises a coiling head 2 adapted to deform a wire stock supplied from a rolling mill, for example into a coil and a storing device 4 located beneath the coiling head 2 to temporarily store and prevent falling of the coil 3 during the exchange of a carrier or pallet. Usually, the storing device 4 is provided with a pair of arresting plates 5 operated by pneumatic cylinders 6. Each arresting plate has a sufficient width in the diametric direction of the coil 3 and when it is operated by the pneumatic cylinder 6 toward the outside of the storing device 4 its inner end disengages the coil 3 thus permitting it to fall. When the arresting plates are moved inwardly to the position shown in FIG. 1 they support a bundle 7 of coil turns so as to prevent it from falling into the carrier 8, during which cutting of the wire stock and exchange of the carrier can be performed.

Although in FIG. 1 the coil storing device 4 is shown as comprising a pair of arresting plates 5 and a pair of pneumatic cylinders 6 for driving the same, the coiler actually used has a more complicated construction. For example, a mechanism of a photographic camera is used wherein a plurality of vanes are synchronously moved to vary the diameter of an opening defined by the vanes.

Figure 2:
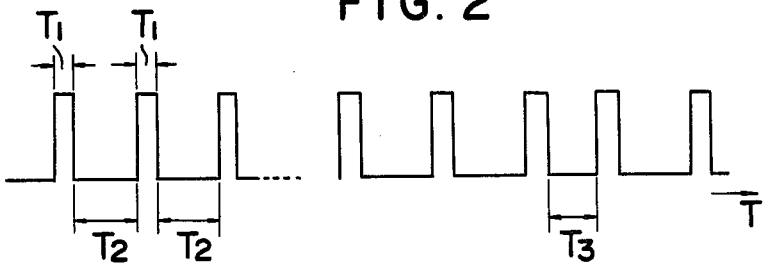
FIG. 2 is a time chart showing a manner of operation of the coiler shown in FIG. 1.
Figure 3:
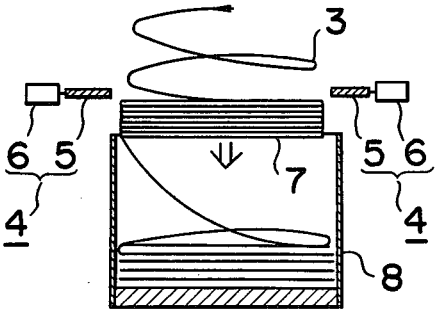
FIG. 3 is a diagrammatic sectional view showing the coiler shown in FIG. 1 in a different operating condition.

The method of forming a wire stock into a coil of this invention is carried out in the following manner. Thus, instead of exchanging a carrier or a pallet as above described, the arresting plates 5 are reciprocated intermittently at a predetermined interval by means of a timer or the like as shown in FIG. 2. More particularly, when the arresting plates 5 are moved inwardly as shown in FIG. 1, the bottom of the storing device 4 is closed whereas when they are moved outwardly, the bottom of the storing device 4 is opened. Denoting the interval in which the bottom of the storing device 4 is opened by $T_1$, and the interval in which the bottom is closed by $T_2$, the bundle 7 of the coil accumulated in the storing device during interval $T_2$ is discharged into the carrier 8 during the interval $T_2$, as shown in FIG. 2. By suitably determining the length of intervals $T_1$ and $T_2$ in accordance with the diameter of the wire stock and the coiling speed, the bundle 7 drops on the bundle or bundles already accumulated in the carrier 8 and reduces the gaps between the turns by an impact force created by the weight of the falling bundle. The gaps of the newly accumulated bundle are also reduced thus forming a compact coil.

As above described, the method of this invention can readily be carried out by merely adding arresting plates, pneumatic pistons, a timer and electromagnetic valves controlled by the timer for actuating the pneumatic cylinders to an existing coiler. Moreover, as the coil storing device is located close to the coiling head 2, the bundle of the coil 7 stored in the storing device 4 is in more favorable condition than in the carrier 8 or pallet so that it is possible to form a compact coil.

When coiling a copper wire having a diameter of 9.5 mm and running at a speed of 230 to 240 m/sec. it was found that intervals of 60 to 100 seconds and one second are preferable for $T_2$ and $T_1$, respectively. If $T_2$ were shorter than 60 seconds, the amount of the coil accumulated in the storing device would be deficient so that when a bundle of the coil is dropped the advantageous effect of this invention could not be attained. On the other hand, if $T_2$ were longer than 100 sec, the weight of the bundle would become excessive so that it would become difficult to actuate the arresting plates. Under these conditions if the arresting plates were forced outwardly, there is a fear of damaging the wire stock.

The time $T_3$ required for exchanging the carrier 8 is preferred to be shorter than the interval $T_2$.

What is claimed is:

1. In the known method of handling wire stock wherein the wire is deformed into a continuous succession of coils that are deposited upon one another in a generally vertical stack until the stack has reached the desired height or weight, whereupon that coil stack is removed and a new coil stack started, the improvement which comprises (a) establishing an intermediate support zone for the accumulation of a bundle of coiled turns, (b) establishing a final zone for the accumulation of a plurality of bundles of coiled turns, (c) said intermediate zone being located at a fixed vertical height D above said final storage zone, (d) allowing a first bundle of coiled turns to accumulate at said intermediate support zone for a time interval $T_2$, (e) at the end of time interval $T_2$ withdrawing the support from said first bundle that has accumulated at said intermediate support zone so that said first bundle with drop through the distance D and suddenly impact downwardly upon said final storage zone, said withdrawal of support being for a time interval $T_1$, (f) repeating steps (d) and (e) with successive bundles whereby the successive impact forces created by the weight of each falling bundle reduces the gaps between the coil turns and forms a final compact coil stack, (g) removing a final compact coil stack from said final storage zone during the time interval $T_3$, (h) time interval $T_2$ being greater than both time intervals $T_1$ and $T_3$.

2. The method according to claim 1 wherein $T_2$ is from 60 to 100 seconds and $T_1$ is one second.

* * * * *